US005962802A

United States Patent [19]

Iizuka

[11] Patent Number: 5,962,802

[45] Date of Patent: Oct. 5, 1999

[54] AUTOMATIC PERFORMANCE DEVICE AND METHOD CAPABLE OF CONTROLLING A FEELING OF GROOVE

[75] Inventor: Akira Iizuka, Hamamatsu, Japan

[73] Assignee: Yamaha Corporation, Japan

[21] Appl. No.: 09/175,513

[22] Filed: Oct. 20, 1998

[30] Foreign Application Priority Data

Oct. 22, 1997 [JP] Japan ..... 9-290011

[51] Int. Cl.[6] ..... G10H 1/053; G10H 1/06; G10H 1/26

[52] U.S. Cl. ..... 84/609; 84/615; 84/622; 84/626; 84/633

[58] Field of Search ..... 84/609–620, 622–638

[56] References Cited

U.S. PATENT DOCUMENTS 5,241,125 8/1993 Miyamoto ..... 84/609
5,495,073 2/1996 Fujishima et al. ..... 84/609
5,654,517 8/1997 Miyamoto ..... 84/609

FOREIGN PATENT DOCUMENTS 61-140994 6/1986 Japan .
2-131292 5/1990 Japan .

*Primary Examiner*—Stanley J. Witkowski
*Attorney, Agent, or Firm*—Rossi & Associates

[57] ABSTRACT

Groove data for imparting a variation to one or more predetermined factors, such as generation timing, gate time and velocity, of a tone based on the automatic performance data are stored in a memory as a groove template. Further, modification data for modifying variation amounts of the predetermined factors are stored in the memory in a time series in corresponding relation to progression of an automatic performance. Automatic performance is carried out by modifying the variation amounts of the one or more predetermined factors in the groove template in accordance with the modification data and thus modifying the predetermined factors of the tone, based on the automatic performance data, in accordance with the thus-modified variation amounts.

18 Claims, 9 Drawing Sheets

AUTOMATIC PERFORMANCE DEVICE AND METHOD CAPABLE OF CONTROLLING A FEELING OF GROOVE

BACKGROUND OF THE INVENTION

The present invention relates to automatic performance devices and method which execute an automatic performance while varying a musical factor, such as tone generation timing, gate time or velocity, in automatic performance data, as well as recording media containing an automatic performance program.

Among various types of automatic performance device known today is one which is designed to vary a musical factor, such as tone generation timing, gate time (sounding time length) or velocity (volume), in automatic performance data read out from a memory during an automatic performance without varying the specific substance of the automatic performance data and thereby generate automatic performance tones on the basis of the thus-varied automatic performance data. The automatic performance based on such varied data would give a different impression or feeling from that given by reproducing the original automatic performance data with no variation or modification, i.e., just as stored in the memory. Namely, the musical factor variation can impart a feeling of a subtle ride or groove (expression of the player's performing habit or the like) to the reproduced automatic performance that would otherwise become very monotonous. Such a musical factor varying technique is disclosed in U.S. Pat. No. 5,495,073.

According to the known technique, groove data for imparting a groove feeling to the automatic performance data has a predetermined length, such as a length of a single measure, and one groove data set is provided in association with all automatic performance data of a music piece or an accompaniment pattern or other performance pattern. To vary the automatic performance data of a music piece, the same groove data set is used repetitively. Further, examples of the automatic performance device where the automatic performance data comprise data of a plurality of tracks include one where the groove data can be set to a different value for each of the tracks.

However, because only one groove data set is provided in association with a single music piece or a single performance pattern and only fixed variations are imparted by the same groove data set in reproduction of the automatic performance, the conventionally-known automatic performance devices present the problem that the automatic performance executed thereby would unavoidably become monotonous. There has also been proposed a technique which, during the course of an automatic performance, modifies, in real time, a manner in which the groove data operate (i.e., the degree of effectiveness of the groove data) in response to player's manipulation of a specific operator, but this proposed technique is unable to repeat such real-time modification in association with the automatic performance data. Similar techniques are disclosed in U.S. Pat. Nos. 5,241,125 and 5,654,517 and Japanese Patent Laid-open Publication Nos. SHO-61-140994 and HEI-2-131292, but all of these fail to show or teach a solution to the above-discussed problem.

SUMMARY OF THE INVENTION

It is therefore an object of the present invention to provide an automatic performance device which, on the basis of groove data, can modify a factor of generated tones in real time in accordance with progression of an automatically-performed music piece and also reproduce the real-time factor modification repeatedly any desired number of times.

In order to accomplish the above-mentioned object, the present invention provides an automatic performance device which comprises: a performance data supply section that supplies automatic performance data; a groove data supply section that supplies groove data for imparting a variation to one or more predetermined factors of a tone based on the automatic performance data; a modification data storage section that stores modification data for modifying variation amounts of the one or more predetermined factors, in a time series in corresponding relation to progression of an automatic performance; and a performance executing section that executes an automatic performance by reading out the modification data from the modification data storage section in accordance with progression of the automatic performance, modifying the variation amounts of the one or more predetermined factors, based on the groove data, in accordance with the modification data and modifying the one or more predetermined factors of the tone based on the automatic performance data in accordance with the modified variation amounts.

With this arrangement, the modification data stored in the modification data storage section in a time series in corresponding relation to progression of an automatic performance are sequentially read out in accordance with the progression of the automatic performance, the variation amounts of the one or more predetermined factors, based on the groove data, are varied in accordance with the read-out modification data, and then the predetermined factors of the tone based on the automatic performance data are varied in accordance with the modified variation amounts, to thereby execute an automatic performance. Thus, the variations of the predetermined tone factors factors can be modified on a real-time basis in accordance with progression of an automatically-performed music piece and also reproduce the manner of the real-time factor modifications repeatedly any desired number of times. The predetermined factors of the tone based on the automatic performance data are, for example, generation timing, gate time and velocity of the tone.

In the automatic performance device, the groove data supply section, during reproduction of an automatic performance, is capable of supplying the groove data while selectively switching between a plurality of types of the groove data to be supplied thereby and also capable of supplying a plurality of types of reference modification data that are specific to respective ones of the types of the groove data. When the groove data to be supplied is switched from one of the types to another of the types by the groove data supply section, the performance executing section modifies the variation amounts of the one or more predetermined factors using the reference modification data specific to the groove data of the other type, in place of the modification data read out from the modification data storage section. Thus, upon switching of the groove data type, the variation amounts of the predetermined factors based on the groove data can be modified using the reference modification data suitable for the newly selected groove data, in place of the modification data having been used till the groove data type switching.

Also, in the automatic performance device, the performance data supply section includes a storage section that stores the automatic performance data of a plurality of tracks, and the modification data storage section stores the modification data of a plurality of tracks corresponding to the automatic performance data of the plurality of tracks, and wherein the performance executing section, independently for each of the tracks, modifies the the variation amounts of the one or more predetermined factors for the automatic performance data of the track in accordance with the modification data of the track. With this arrangement, it is possible to modify the variation amounts of the predetermined factors, independently for each of the automatic performance tracks (i.e., for each performance part).

The present invention further provides an automatic performance device which comprises: a performance data supply section that supplies automatic performance data; a groove data supply section that supplies groove data for imparting a variation to one or more predetermined factors of a tone based on the automatic performance data; a writable modification data storage section that stores modification data for modifying variation amounts of the one or more predetermined factors, in a time series in corresponding relation to progression of an automatic performance; a modification data writing section that receives desired modification data and writes the desired modification data into the modification data storage section; and a performance executing section that executes an automatic performance by reading out the modification data from the modification data storage section in accordance with the progression of the automatic performance, modifying the variation amounts of the one or more predetermined factors, based on the groove data, in accordance with the modification data and modifying the one or more predetermined factors of the tone based on the automatic performance data in accordance with the modified variation amounts. With this arrangement, the user can enter and write any desired modification data into the modification data storage section in a time-series fashion.

The present invention can be arranged and practiced as a method invention as well as the device invention as mentioned above. Further, the present invention can be implemented as a computer program and as a recording medium containing such a computer program.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
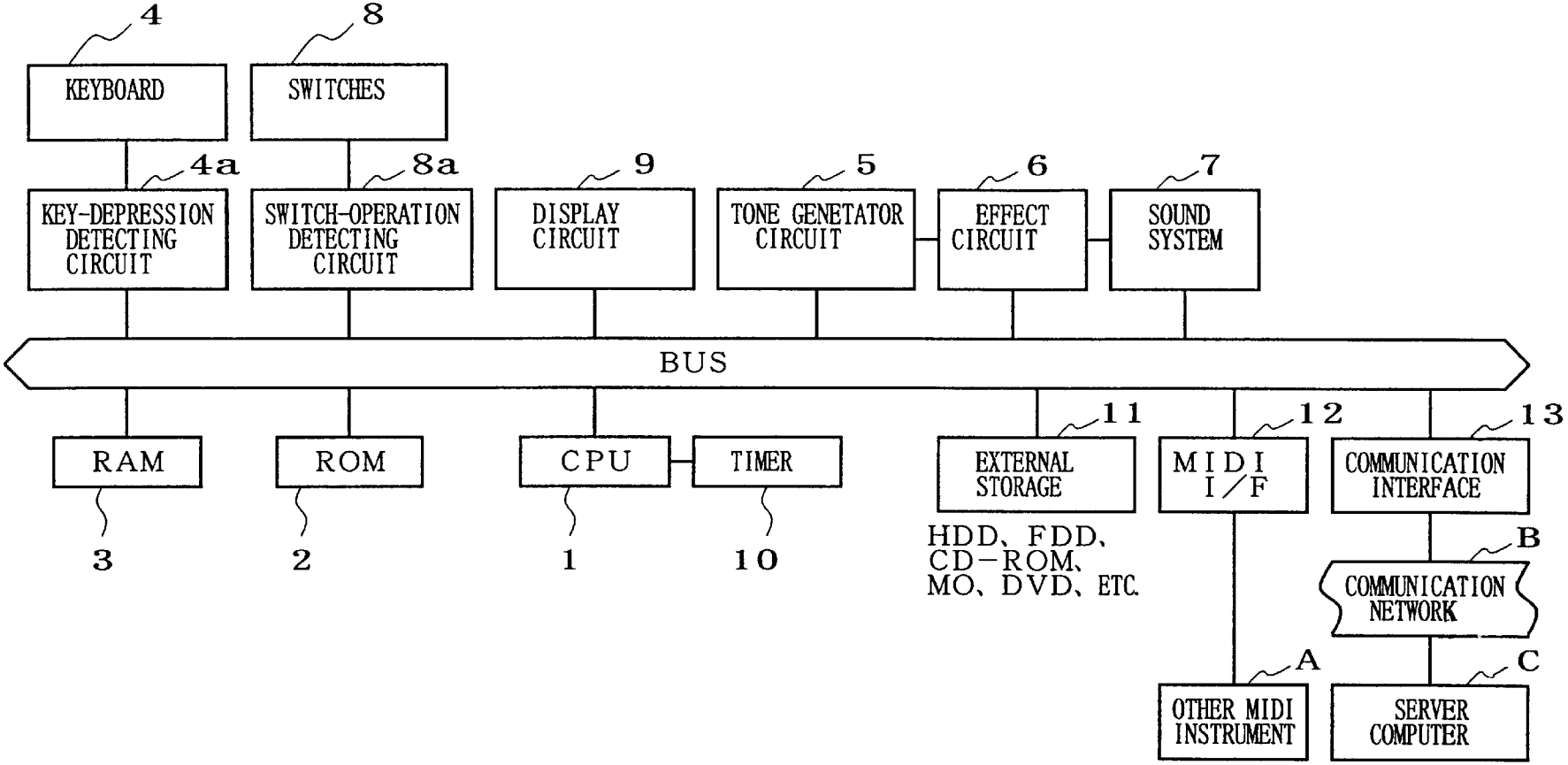
FIG. 1 is a block diagram showing an electronic musical instrument employing an automatic performance device of the present invention, as well as a network system to which the electronic musical instrument is connected.

FIG. 1 is a block diagram showing an electronic musical instrument employing an automatic performance device of the present invention, as well as a network system to which the electronic musical instrument is connected. In the electronic musical instrument, a CPU 1 controls overall operations of the electronic musical instrument on the basis of control programs prestored in a ROM 2 and by use of a working area of a RAM 3. When a performance is being executed on a keyboard 4, the CPU 1 receives, via a key-depression detecting circuit 4*a*, a note number, key-on signal, etc. of each depressed or operated key and also supplies a tone generator circuit 5 with the note numbers, velocity data and note-on/off instruction to carry out tone generating or tone deadening operations. The tone generator circuit 5 in this embodiment is capable of simultaneously generating tones in a plurality of channels (e.g., 16 channels) on a time divisional basis. More specifically, the tone generator circuit 5 generates tone signals of a predetermined colors or timbre (tone color allocated to a keyboard region in the case of a key-on event on the keyboard) on the basis of note numbers, note-on instructions and velocity data given by the CPU 1; in the case of a key-on event for an automatic accompaniment track or the like, the tone generator circuit 5 generates a tone signal of a color preset for that track. The tone signals generated by the tone generator circuit 5 are imparted various effects by an effect circuit 6 and then audibly reproduced or sounded through a sound system 7. Each sounded tone signal is decayed or deadened in response to the note number designation and note-off instruction by the CPU 1.

Switches 8 are provided on an operation panel of the electronic musical instrument, and the CPU 1, by means of a switch-operation detecting circuit 8a, receives data entered via the switches and carries out various operations depending on the switches operated. The switches 8 on the operation panel include a switch for selecting a recording mode (play effect track recording mode) to record modification data during the course of an automatic performance. Display circuit 9 comprises a liquid crystal display (LCD), and user's entry operations may be made via a so-called GUI (Graphical Users Interface) using such a liquid crystal display as well as the switches 8.

For example, screen switches may be graphically shown on the liquid crystal display of the display circuit 9 and a cursor may be set on the screen of the display by operating a particular one of the switches. Further, various entry operations, such as modification of data values associated with the screen switches, can be performed by the user operating an up/down switch or the like. Examples of the entry operations using the GUI include real-time modification of tone generation timing, gate time, velocity and the like (those of the screen switches used for such purposes will hereinafter be called "play effect operators"), and selection of tone colors to be assigned to the keyboard 4.

In addition, the CPU 1 sets performance tempo information, designated by the user, in a timer 10. The timer 10 in turn generates tempo clock pulses in accordance with the thus-set performance tempo, so that the CPU 1 executes interrupt processing every clock pulse to carry out various operations necessary for an automatic performance. Namely, generation and muting of each automatic performance tone are effected by supplying a note number, velocity and note-on/off instructions, on the basis of automatic performance data with tonal factors modified as will be later described. Note that in this embodiment, the length of a quarter note corresponds to 96 clock pulses and the length of one measure in four-four (4/4) time or meter corresponds to 384 clock pulses.

External storage device 11 comprises any one or more of a hard disk device (HDD), floppy disk device (FDD), CD-ROM device, magneto-optical disk (MO) device, digital versatile disk (DVD) device and so forth, which may be used for entry and storage of various data such as automatic performance data. MIDI interface (I/F) 12 is provided to permit communication of various data, such as automatic performance data, with another MIDI instrument A. Further, a communication interface 13 is connected to a communication network B to receive from a server computer C various data, such as automatic performance data, and/or various programs.

In the illustrated example, automatic accompaniment pattern data for one or more measures constitute the automatic performance data, and the automatic accompaniment pattern is modified by later-described groove template data, during which time the amount of the variation by the groove template data is varied by later-described play effect data and modification data. The purpose of varying the automatic accompaniment pattern by the groove template data is to change data of the major tone factors, i.e., generation timing, gate time and velocity, in the pattern so that these data fit well with a particular performance type, such as swing, beat rock or other music genre, of the music piece in question.

Because tone generation timing of performance data created by, for example, user's actual performance on a keyboard, may unavoidably deviate from predetermined or accurate beat positions, the so-call "quantization" function has been used to modify the tone generation timing of the performance data to coincide with the accurate beat positions. Thus, in this embodiment as well, the "quantizationu" function is performed on the accompaniment pattern to modify its tone generation timing.

Figure 2:
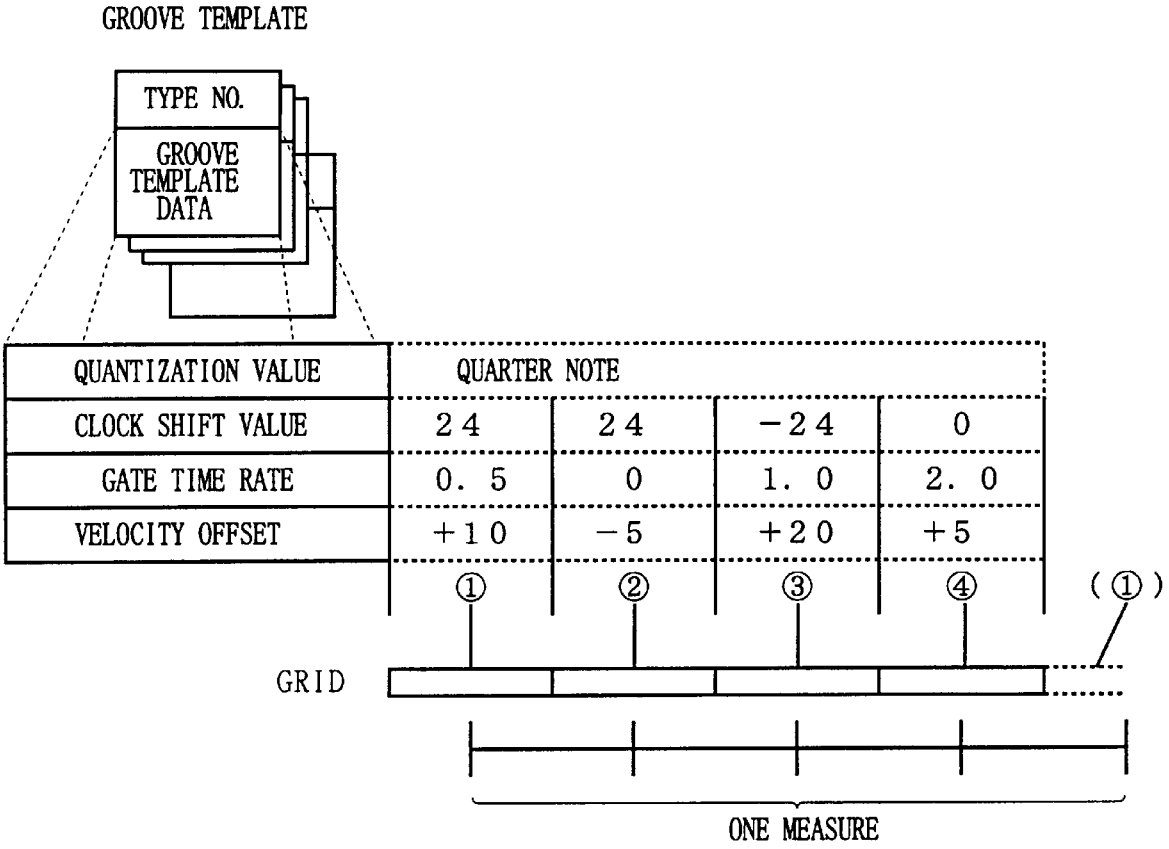
FIG. 2 is a diagram showing an exemplary format of groove templates employed in the embodiment of FIG. 1.

As shown in FIG. 2, a plurality of types (different sets) of groove template data are prestored in the above-mentioned ROM 2 as groove templates, along with unique numbers indicative of the template types. It will be appreciated that the user is allowed to remake each of the groove templates or create a new one therefrom after copying it into the RAM 3. Each of the groove template data sets includes "quantization values" data for designating a beat that forms a basis of quantization; specifically, the quantization value data designates a 16th, 8th, quarter note or the like. Note that each processing unit based on a particular beat position designated by a quantization value in the embodiment will hereinafter be referred to as a "grid".

Further, each of the groove template data sets includes, for each of the grids, "clock shift value" data indicative of a particular number of clock pulses corresponding to a forward or rearward shift amount of generation timing of a tone, "gate time rate value" data indicative of a rate at which the gate time of a tone is to be increased or decreased and "velocity offset value" data indicative of a rate at which the velocity of a tone is to be increased or decreased. As specifically denoted in a dotted-line block of FIG. 2, four sets of the clock shift value, gate time rate value and velocity offset value are included for every four grids forming a single measure. In the case of the groove template for a four-four-time measure, 16 sets of the clock shift value, gate time rate value and velocity offset value are included when the quantization value designates a 16th note, and eight sets are included when the quantization value designates an eighth note. These clock shift value, gate time rate value and velocity offset value are calculated with play effect data of FIG. 3 and later-described modification data, so as to vary the generation timing, gate time and velocity of the tone.

Figure 3:
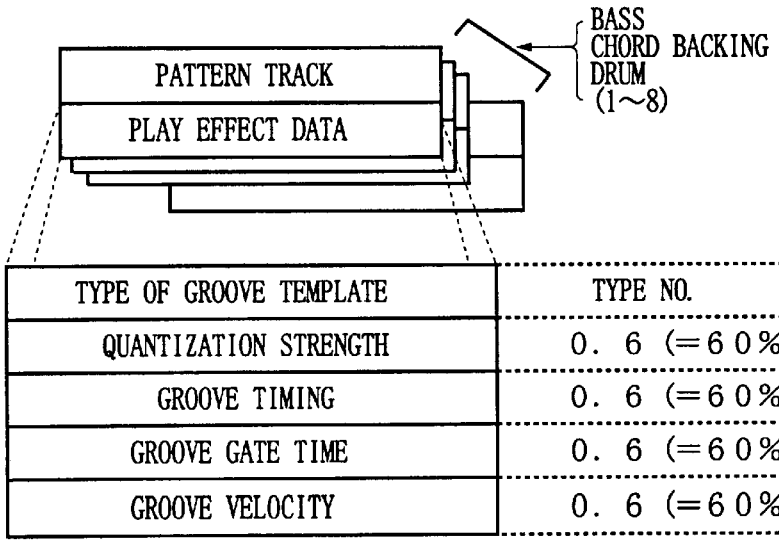
FIG. 3 is a diagram showing an accompaniment pattern and an exemplary format of play effect data employed in the embodiment of FIG. 1.

As shown in FIG. 3, the play effect data are prestored in the ROM 2 in combination with accompaniment pattern track data of the accompaniment patterns. It will be appreciated that the user is allowed to remake the accompaniment pattern track data and play effect data or create new ones therefrom after copying them into the RAM 3. Each of the accompaniment patterns in the illustrated example comprises a total of eight tracks, such as a base track, a plurality of chord backing tracks and a drum track, and separate play effect data are set for each of the tracks. With the play effect data, it is possible to modify the degree of effectiveness of the groove template data.

More specifically, the play effect data include "groove template type" data designating a particular type of the groove template data set to be modified, "quantization strength" data that is a value determining a specific degree of effectiveness of quantization, and "groove timing" data that is a value determining how far the clock shift set by the groove template data is applied to a tone to be generated. The play effect data also include "groove gate time" data that is a value determining how far the gate time rate set by the groove template data is applied to a tone to be generated, and "groove velocity" data that is a value determining how far the velocity offset set by the groove template data is applied to a tone to be generated. Values noted in a dotted-line block of FIG. 3 specifically show that each of the data is set to a value "0.6" (indicative of 60% effectiveness).

Figure 4:
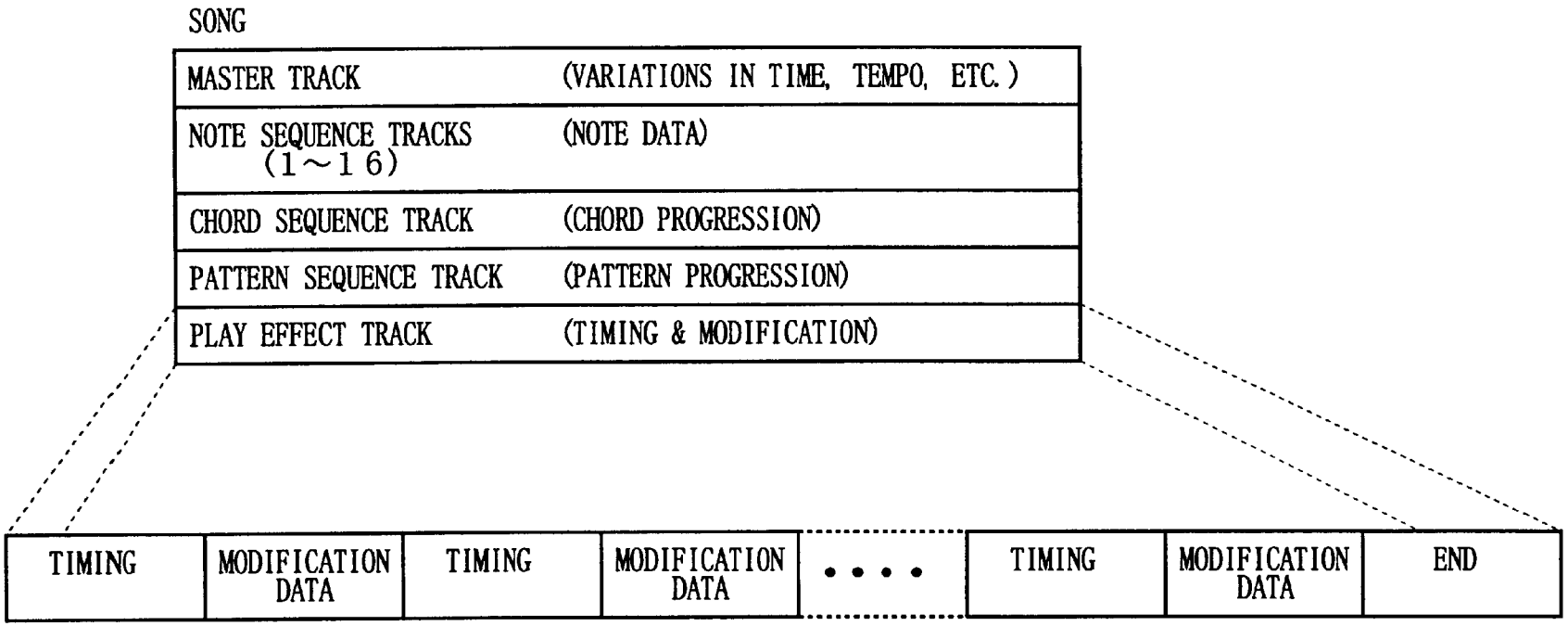
FIG. 4 is a diagram showing an exemplary format of music information for a piece of music or a song to be automatically performed in the embodiment of FIG. 1.

FIG. 4 is a diagram showing an exemplary format of music information for a piece of music to be automatically performed in the embodiment along with the accompaniment pattern—such music information will hereinafter be called a "song". As shown, each song includes a master track, note sequence tracks, a chord sequence track, a pattern sequence track and a play effect track.

In the illustrated example, the master track has recorded therein variations of time or meter, performance tempo, etc, and each of the note sequence tracks has recorded therein note data, such as generation timing, pitch (in the case of a drum sound, a particular type of percussion instrument), velocity, gate time, etc. of a tone. Further, the chord sequence track has recorded therein chord progression data of the music piece, such as chord change timing and other chord data including a chord root and type (and a bass in the case of an on-base chord), and the pattern sequence track has recorded therein accompaniment pattern progression data, such as change timing, pattern number, etc. of the accompaniment pattern The play effect track is provided, in corresponding relation to a modification data storage means, for storing modification data in a time-serial fashion. Namely, the modification data vary with the passage of time and are stored along with data indicative of respective modification timing; note that the modification timing data is represented by a time interval between successive modification timing. The modification data may, for example, one of a "replacement value" for directly replacing the play effect data annexed to the accompaniment pattern and a "modification values" indicative of an amount by which the play effect data is to be increased or decreased, although the embodiment will hereinafter be described primarily in relation to the case where the modification data comprises the replacement value. The modification data includes track number data designating a unique number (1–8) of a particular track for which the value is to be changed, modification type data indicative of a particular type of play effect data whose value is to be modified (i.e., any one of the quantization strength, groove timing, groove gate time and groove velocity), and replacement value (or modification value) data. Namely, four different types of modification data are stored mixedly for a total of eight tracks. Note that the replacement value (or modification value) is in the range of "0" to "1" representing one of 0% to 100% effectiveness.

Figure 5:
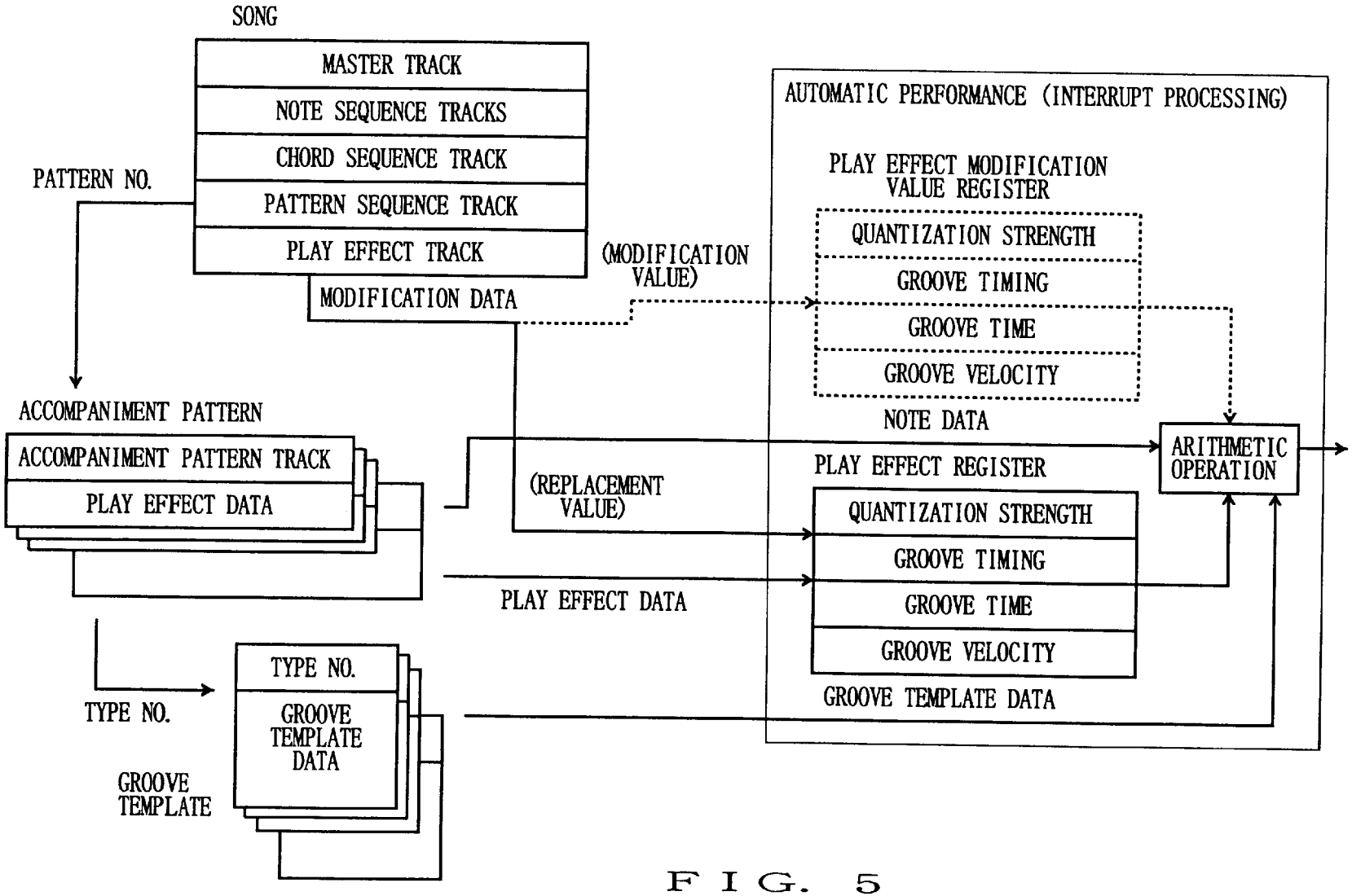
FIG. 5 is a conceptual diagram illustrating an essential construction and operation of the embodiment of FIG. 1.

FIG. 5 is a conceptual diagram illustrating an essential construction and operation of the embodiment of FIG. 1. The groove templates and accompaniment patterns are stored in the ROM 2 and the song is stored in the RAM 3; note that each user-created groove template and accompaniment pattern are stored in the RAM 3. Upon start of an automatic performance, data readout from the individual tracks of the song is initiated, when the note sequence tracks also start tone generation. One of the accompaniment patterns is selected which corresponds to the pattern number of the pattern sequence track, and also one of the groove templates is selected which corresponds to the groove template number of the play effect data in the selected accompaniment pattern.

The note data of the accompaniment pattern track in the selected accompaniment pattern are transferred to an arithmetic operation unit, while the play effect data in the selected accompaniment pattern are transferred to a play effect register. Simultaneously, the groove template data in the selected groove template are transferred to the arithmetic operation unit, and the modification (replacement value) data of the play effect track of the song are transferred to the play effect register. Each stored data in the play effect register is then transferred to the arithmetic operation unit. It will be appreciated that transfer timing (reproduction timing) of these data is controlled on the basis of the respective timing data associated therewith and automatic performance timing.

The arithmetic operation unit is implemented by an arithmetic operation program executed by the CPU 1, which carries out arithmetic operations on the basis of the note data, various data transferred from the play effect register and groove template data. This way, the arithmetic operation unit outputs each operation result as data having modified generation timing, gate time and velocity of a tone, so that an automatic performance tone (in this instance, an automatic accompaniment tone) is audibly generated. Flows of the data from the note sequence tracks and the like of the song are not illustrated for simplicity.

The play effect data of the accompaniment pattern, which are written in the play effect register, are replaced by the modification (replacement value) data of the song's play effect track whenever the modification data timing arrives. Namely, at each modification data timing, the groove template data are modified by the modification data of the play effect track, so that the note data is varied by the resultant modified data.

In the case where the modification data of the play effect track is in the form of a modification value, a play-effect modification value register is used as denoted at broken line in FIG. 5, and the modification data (modification value) is transferred to the play-effect modification value register. In this case, the arithmetic operation unit modifies the data of the play effect register (i.e., play effect data of the accompaniment pattern) using the modification value, so that the note data is varied by the resultant modified data.

In the case where the modification data is in the form of a replacement value, the arithmetic operation unit computes modified values of the velocity, gate time and tone generation timing as follows. Namely, the modified velocity may be computed by the following equation:

$$Vn=Vo+(Vof\times Vgv) \qquad \text{Equation (1)}$$

where Vn represents the modified velocity, Vo an original or unmodified velocity, Vof a velocity offset value, and Vgf a groove velocity (replacement value).

The modified gate time may be computed by the following equation:

$$Gn=Go\times(1+(Rgt-1)\times Ggv) \qquad \text{Equation (2)}$$

where Gn represents the modified gate time, Go an original gate time, Rgt a gate time rate, and Ggv a groove gate time (replacement value).

The modified tone generation timing may be computed by the following equation:

$$Tn=To-(To-Tgr)\times Qst+(Cs\times Tgv) \qquad \text{Eq. (3)}$$

where Tn represents the modified tone generation timing, To original tone generation timing, Qst a quantization strength, Cs a clock shift value and Tgv groove timing (replacement value).

In the case where the modification data is in the form of a modification value, the arithmetic operation unit computes modified values of the velocity, gate time and tone generation timing as follows. Namely, the modified velocity may be computed by the following equation:

$$Vn=Vo+(Vof\times(Vogv+Vxgv) \qquad \text{Equation (4)}$$

where Vn represents the modified velocity, Vo an original velocity, Vof a velocity offset value, Vogv an original groove velocity (play effect data), and Vxgv a groove velocity (modification value).

The modified gate time may be computed by the following equation:

$$Gn=Go\times(1+(Rgt-1)\times(Gogv+Gxgv)) \qquad \text{Eq. (5)}$$

where Gn represents the modified gate time, Go an original gate time, Rgt a gate time rate, and Gogv an original gate time (play effect data), and Gxgv a groove gate time (modification value).

Further, the modified tone generation timing may be computed by the following equation:

$$Tn=To-(To-Tgr)\times Qst+(Cs\times(Togv+Txgv)) \qquad \text{Eq. (6)}$$

where Tn represents the modified tone generation timing, To original tone generation timing, Tgr grid timing, Qst a quantization strength, Cs a clock shift value, Togv original groove timing (play effect data), and Txgv groove timing (modification value).

Figure 6:
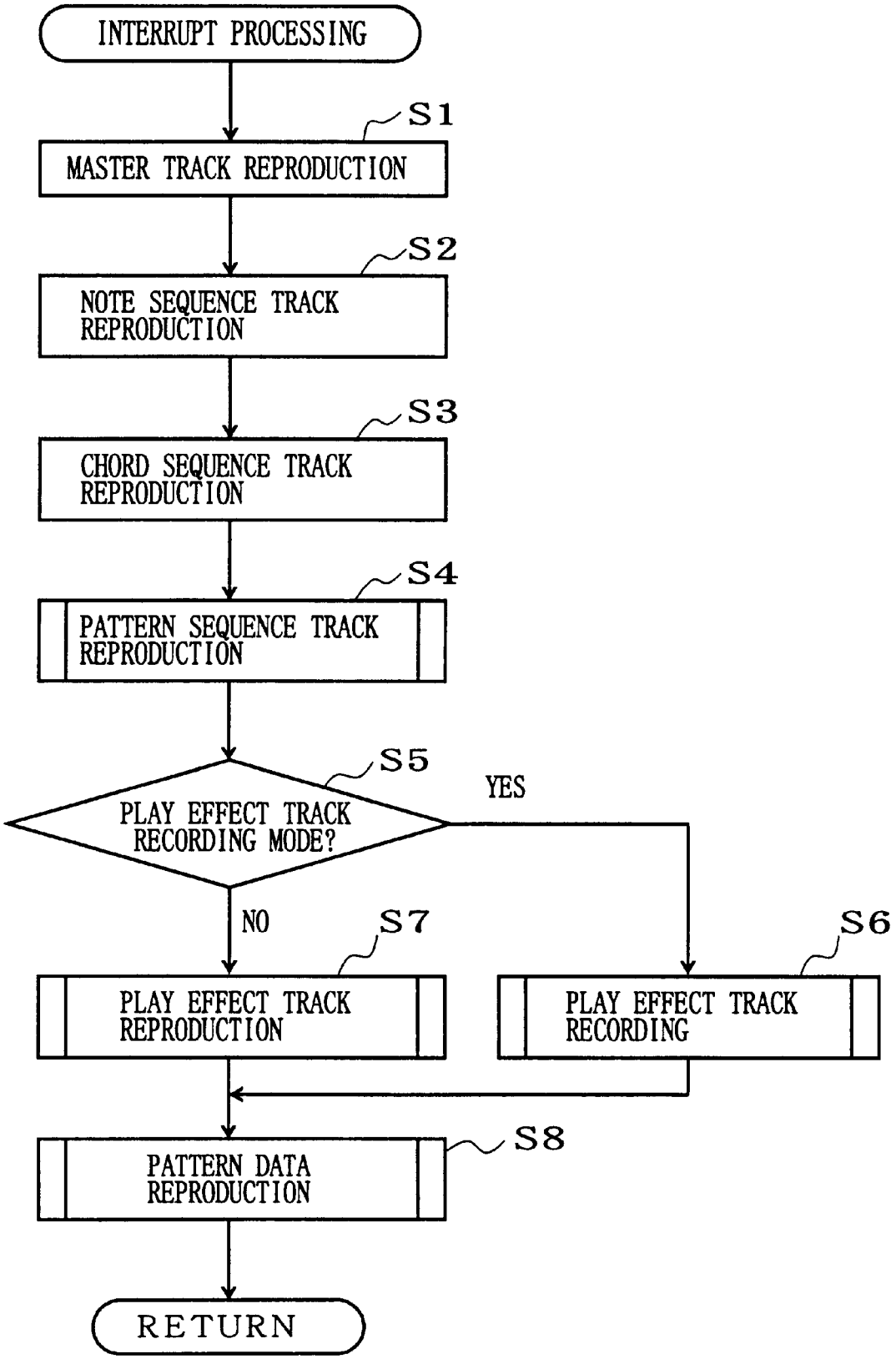
FIG. 6 is a flow chart of interrupt processing executed in the embodiment via an automatic performance program.

FIG. 6 is a flow chart of interrupt processing executed in the embodiment via an automatic performance program, and FIGS. 7 to 10 are flow charts of various subroutines. Behavior of the embodiment will now be described in greater detail with reference to these flow charts. Here, timing to change or switch the pattern number designated by the pattern sequence track, timing to switch the modification data of the play effect track and tone-generation event timing of the accompaniment pattern is each designated by timing data indicative of a time interval between the successive switch timing or between the successive tone-generation event timing. In the following description and associated flow charts, registers for measuring the above-mentioned timing and track number registers are represented by the following labels, and stored contents of these registers are also represented by the same labels as used for the registers unless stated otherwise.

TIME1: This label represents a register for measuring timing (time interval) of the patter sequence track.

TIME2: This label represents a register for measuring timing (time interval) of the play effect track.

TR: This label represents a register for storing a track number (0–7) of an accompaniment pattern.

TIME(TR): This label represents a register for measuring timing (time interval) for a track number TR of an accompaniment pattern.

The processes to be described below are carried out upon start of an automatic performance mode, where first timing data of the pattern sequence track is set into the TIME 1 register and respective first timing data of the individual tracks of the accompaniment pattern are set into the associated TIME(TR) registers. Further, first timing data of the play effect track is set into the TIME2 register upon start of the automatic performance mode, which is, however, reset once the operating mode is switched to a play effect track recording mode.

The interrupt processing of FIG. 6 is triggered, in response to clock pulses given from the timer 10, with a frequency of 96 times per quarter note. At first step Si, the master track is reproduced, and a predetermined modification operation is carried out if a modification is to be made of a reproduction tempo or the like. At next step S2, the note sequence tracks are reproduced to read out the note data, so as to carry out operations for generating and deadening tones of a melody part and the like based on the read-out note data.

Figure 7:
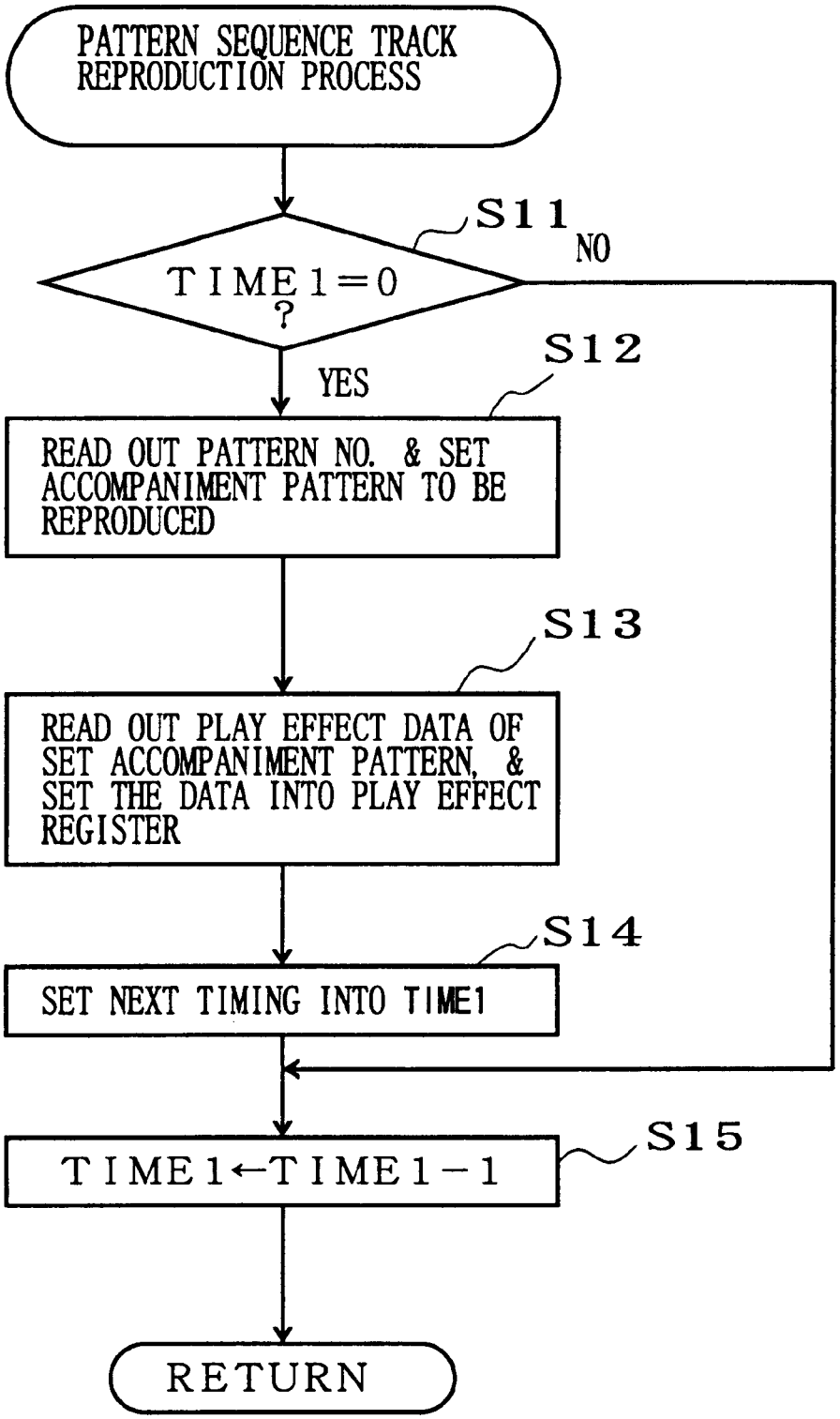
FIG. 7 is a flow chart of a pattern sequence track reproduction process executed in the embodiment.

Then, the chord sequence track is reproduced to read out the chord progression data and chord data (chord root and type or bass) are set into a chord register at step S3, and a pattern sequence track reproduction process is executed at step S4 as shown in FIG. 7. In the pattern sequence track reproduction process, the pattern sequence track of the song is reproduced, the accompaniment pattern is modified at predetermined pattern modification timing, and the play effect data of the accompaniment pattern are set into the play effect register. The play effect register includes regions capable of storing four different replacement values for each of the eight tracks, where all read-out replacement values for all of the tracks are stored. The play effect data thus set into the play effect register constitute "reference modification data" specific to the modified accompaniment pattern.

Further, at step S5 of FIG. 6, a determination is made as to whether or not the currently-set operating mode is the play effect track recording mode. With an affirmative answer, the interrupt processing goes to step S6 in order to carry out a play effect track recording process of FIG. 8, after which the process moves on to step S8. If the currently-set operating mode is not the play effect track recording mode as determined at step S5, then the interrupt processing goes to step S7 in order to carry out a play effect reproduction process of FIG. 9, after which the process moves on to step S8. Then, a pattern data reproduction process of FIG. 10 is executed at step S8, and this way, one execution of the interrupt processing is completed.

In the pattern sequence track reproduction process of FIG. 7, it is ascertained at step S11 whether or not the TIME1 register has now reached a value "0" (TIME1=0), i.e., whether or not predetermined timing to modify the accompaniment pattern has arrived. If answered in the negative (TIME1≠0), the process decrements the TIME1 value by one and returns to the original routine that was being executed immediately before the interrupt. If, however, TIME1=0, the pattern number of the accompaniment pattern to be modified is read out and the accompaniment pattern to be reproduced is changed over to another one at step S12, after which the process moves on to step S13. At step S13, the play effect data of the changed accompaniment pattern are read out and set into the play effect register. Then, next timing data is set into the TIME1 register at step S14, and the process decrements the TIME1 value by one at step S15 and returns to the original routine.

In the case where the modification data is in the form of a modification value, the play effect modification value register may be reset at step S13. Once the play effect modification value register is reset, the values set in the play effect register are reflected directly in the tone generation timing, gate time and velocity; that is, Vxgv (groove velocity), Gxgv (groove gate time) and Txgv (groove timing) in Equations (4), (5) and (6) above become "0". In this way, the play effect data values corresponding to the changed accompaniment pattern can be reelected appropriately in the generated tone.

In changing the accompaniment pattern in the pattern sequence track reproduction process, setting the play effect data of the changed accompaniment pattern into the play effect register and resetting the play effect modification value register in the case where the modification data is in the form of a modification value are preferable in that they significantly facilitate groove modification control suitable for the changed new accompaniment pattern. In the illustrated example, the play effect data of the accompaniment pattern correspond to the "reference modification data".

Figure 8:
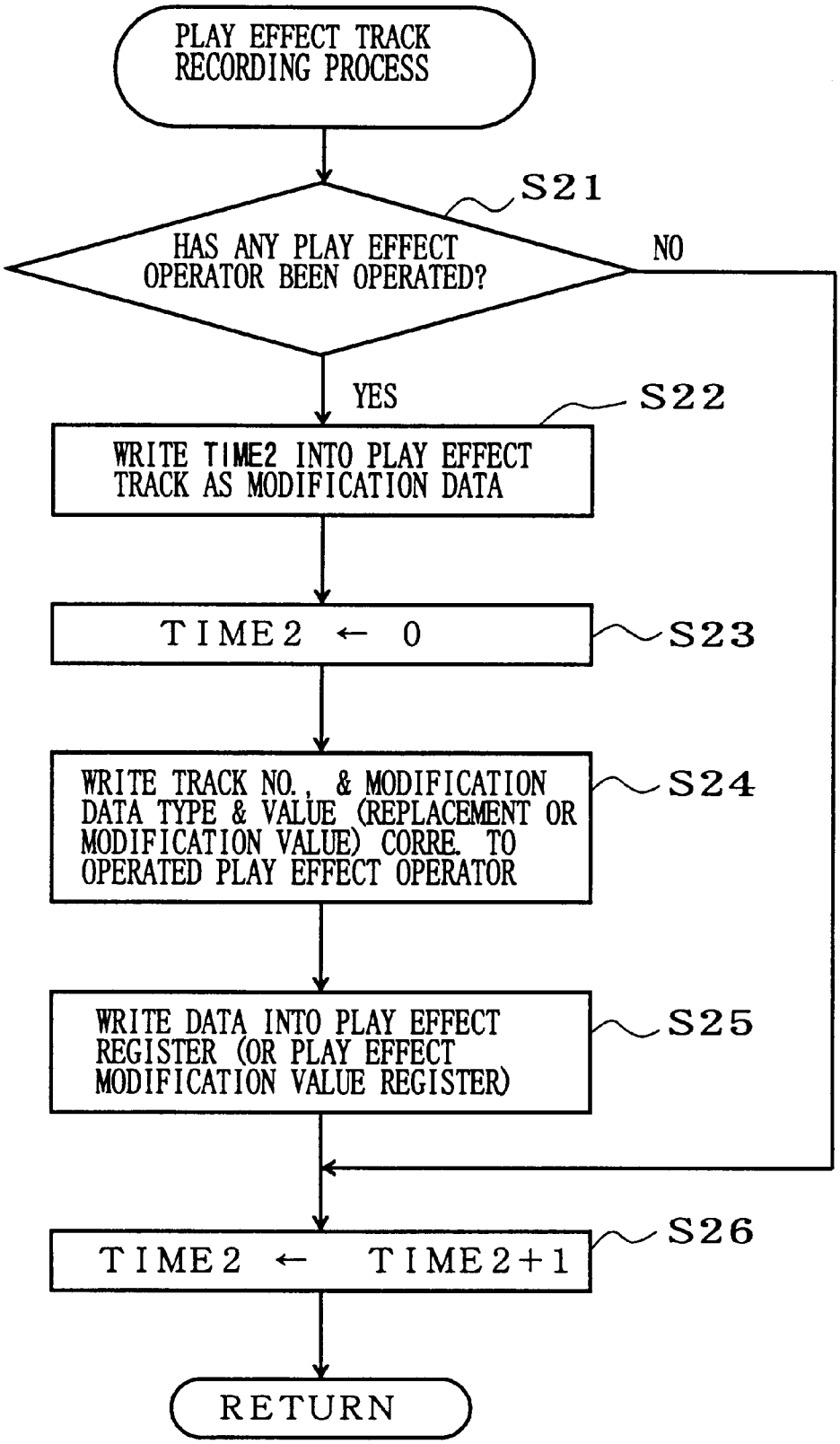
FIG. 8 is a flow chart of a play effect track recording process executed in the embodiment.

The play effect track recording process of FIG. 8 is carried out in the play effect recording mode. By this time, the TIME2 register has been reset to "0" in response to activation of the play effect recording mode, or in response to initiation of the reproduction (recording) after activation of the play effect recording mode. At first step S21, a determination is made as to whether any of the play effect operators (GUI screen switches on the liquid crystal display) has been operated. If answered in the negative, the process increments the TIME2 value by one and returns to the original routine. If answered in the affirmative at step S21, the current stored value in the TIME2 register is written into the play effect track as data indicative of timing to change the modification data over to another at step S22. Then, the process resets the TIME2 register at step S23 and goes to step S24. At step S24, the track number and modification data type and value (replacement value or modification value) of the operated play effect operator are written into the play effect track. At next step S25, the modification data is written into the play effect register (or into the play effect modification value register in the case of the modification value). Then, the process increments the TIME2 value by one at step S26 and returns to the original routine. In the case where the modification data to be written is in the form of a replacement value, the replacement value is stored into a region of the play effect register which corresponds to the track number and modification data type of the operated play effect operator. The play effect modification value register includes regions capable of storing four different modification values for each of the eight tracks, and if the modification data to be written is in the form of a modification value, then the modification value is stored into one of the regions of the play effect modification value register which corresponds to the track number and modification data type of the operated play effect operator.

By the above-described play effect recording process, modification data corresponding to activation of the play effect operator is recorded into the play effect track and also written into the play effect register (or play effect modification value register) at step S25, so that a tone corresponding to the modification operation is generated in a pattern data reproduction process as will be later described in detail.

Figure 9:
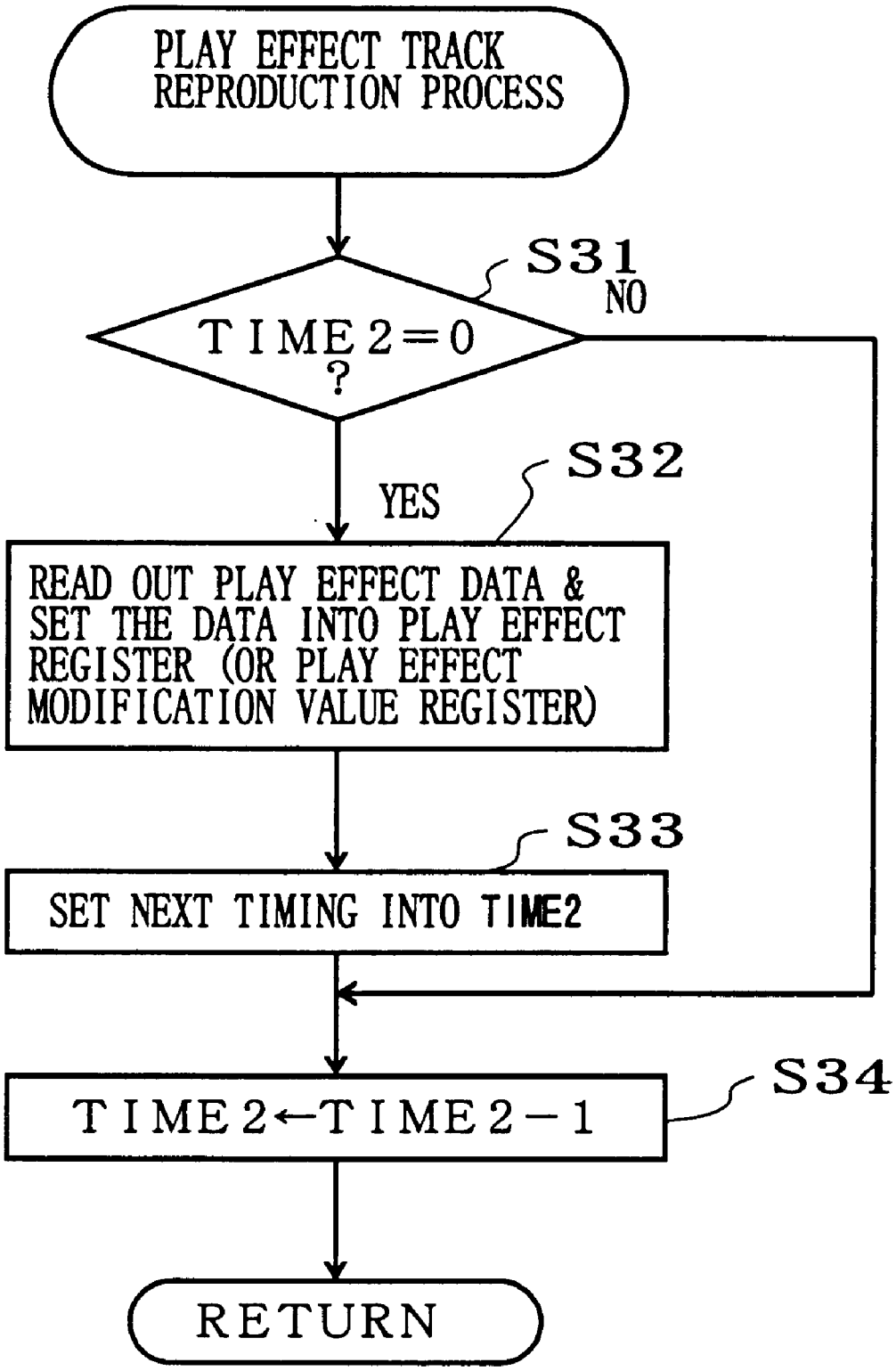
FIG. 9 is a flow chart of a play effect track reproduction process executed in the embodiment.
Figure 10:
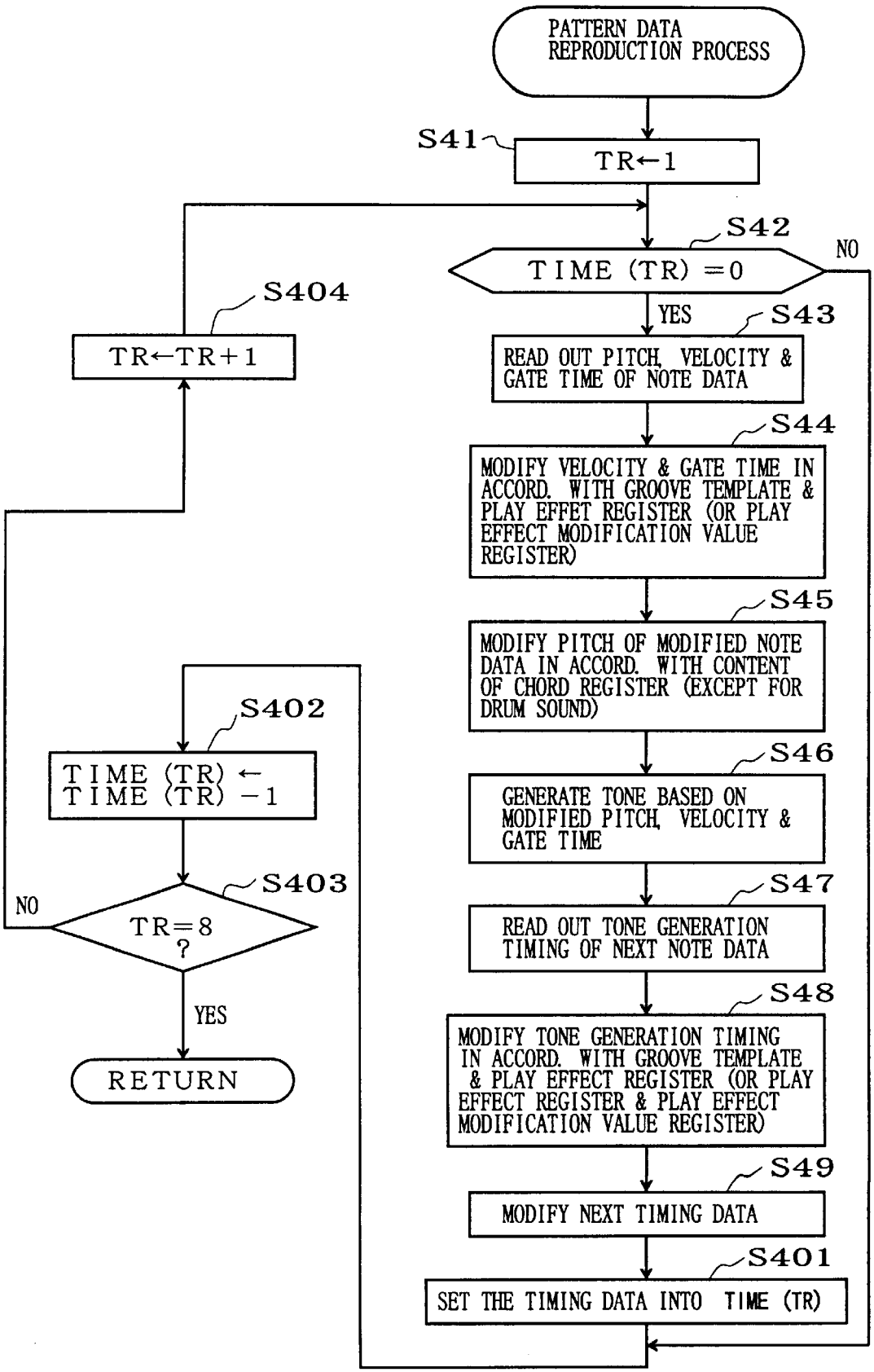
FIG. 10 is a flow chart of a pattern data reproduction process executed in the embodiment.

Play effect track reproduction process of FIG. 9 is carried out when the currently-set operating mode is not the play effect recording mode, i.e., when only reproduction of an automatic performance is to be executed. By now, the first timing data of the play effect track has been set in the TIME2 register in response to selection of a song to be reproduced or upon start of the song reproduction. It is first ascertained at step S31 whether or not the TIME2 register has reached a value "0" (TIME2=0). If answered in the negative (TIME2≠0), the process decrements the TIME2 value by one and returns to the original routine. If, however, TIME2=0, the play effect track reproduction process goes to step S32, where modification data of the play effect track is read out and the replacement value (or modification value) is set into one of the regions of the play effect register (or play effect modification value register in the case of the modification value) which corresponds to the track number and modification type contained in the read-out modification data. Then, next timing data is set into the TIME2 register at step S33, and the process decrements the TIME2 value by one at step S34 and returns to the original routine.

Through the above-described play effect track reproduction process of FIG. 9, a plurality of the modification data of the play effect track are sequentially set into the play effect register (or play effect modification value register) at respective predetermined timing.

In the pattern data reproduction process of FIG. 10, a value "1" is first set into the TR register at step S41, after which operations of steps S42 to S404 are repeated for the eight tracks on the basis of the determination at step S403 and the increment of the TR register value at step S404. More specifically, at step S42, it is determined whether or not the TIME(TR) register has now reached a value "0" (TIME(TR)=0), i.e., whether or not note data of the accompaniment pattern of the current track has arrived at predetermined tone generation timing. If TIME(TR)≠0, it means that the predetermined tone generation timing has not arrived yet, and the process jumps to step S402. If TIME(TR)=0, it means that the predetermined tone generation timing has arrived, and the process proceeds to next step S43 in order to read out the pitch (note code), velocity and gate time of the note data. Then, at step S44, the read-out velocity and gate time of the note data are modified in accordance with the contents of the groove template data and the play effect register (or the play effect register and play effect modification value register in the case where the modification data is in the form of a modification value).

At following step S45, the pitch of the thus-modified note data is converted in accordance with the current stored contents of the chord register (except for a drum sound). Tone generation timing data of next note data is read out at next step S47, and the read-out next tone generation timing data is modified at step S48 in accordance with the contents of the groove template data and the play effect register (or the play effect register and play effect modification value register in the case where the modification data is in the form of a modification value).

If the tone generation timing data has been modified at step S48 in such a way that the corresponding time interval is decreased, next tone generation timing data is modified at next step S49 so that the time interval corresponding thereto is increased by exactly the same amount as the decrease effected at step S48. Similarly, if the tone generation timing data has been modified at step S48 in such a way that the corresponding time interval is increased, next tone generation timing data is modified at step S49 so that the time interval corresponding thereto is decreased by exactly the same amount as the increase effected at step S48. After step S49, the pattern data reproduction process proceeds to step S401, where the timing data is set into the TIME(TR) register. Then, the TIME(TR) value is decremented by one, and the process proceeds to step S403. At step S403, a determination is made as to whether or not the TR register has reached a value "8" (TR=8). If TR≠8, it means that the above-mentioned operations have not been completed for all of the eight tracks, and the process goes to step S404. If, on the other hand, TR=8, it means that the above-mentioned operations have been completed for all of the eight tracks, and the process returns to the original routine.

With the above-described processes, modification data varied with the passage of time in an automatic performance can be recorded into the play effect track of the song. Note that the play effect track will be associated with the accompaniment pattern by the pattern number written in the pattern sequence track of the same song; that is, the modification data is recorded in association with the accompaniment pattern. The recorded modification data allows an automatic accompaniment to be performed with the accompaniment pattern again varied, by reproducing the play effect track.

Whereas the embodiment of the present invention has described above as applied to an automatic performance based on an accompaniment pattern and pattern sequence track and in relation to the case where the accompaniment pattern is treated as "automatic performance data" to be subjected to tonal factor variations, data of note sequence tracks of a song may be processed as the automatic performance data to be subjected to tonal factor variations. In such a case, a different groove template may be applied to each of the note sequence tracks, or a same groove template may be applied to two or more of the note sequence tracks. Further, a plurality of data, each designating a type of the groove template, may be incorporated in the play effect track in such a manner that switching is permitted between different groove templates during the course of an automatic performance.

Further, in the case where the above-described embodiment is applied to the automatic performance based on an accompaniment pattern and pattern sequence track, each groove template may be set independently of the accompaniment pattern, rather than in association with a set of the accompaniment pattern data. For example, a plurality of data, each designating a type of the groove template, may be incorporated in the play effect track.

Furthermore, whereas the embodiment has been described above in relation to the case where play effect data (modification data) for a plurality of tracks are stored mixedly in a single play effect track, such a play effect track may be provided for each of the tracks. In addition, whereas the play effect data (modification data) can be stored using the real-time writing scheme where data indicative of a specific time point at which one of the play effect operators has been activated as well as a selected value corresponding to the activated operator is recorded in real time, the play effect data may also be recorded using the step writing scheme where timing to write the selected value, in addition to the selected value itself, is also designated by the activation of the play effect operator. Moreover, although new play effect data can be recorded using the overwrite recording scheme where previously-recorded data is completely replaced by the new play effect data, the insertion recording scheme may be employed where the new play effect data is inserted between the previously-recorded data. In addition, the play effect data may either be newly recorded by the user or be previously recorded within song data supplied by a manufacturer or the like. Furthermore, the play effect data alone may be supplied separately from the song data so that an effect based on the play effect data is imparted to the song through simultaneous reproduction of the play effect data and song data.

The groove template may be arranged to contain only desired one or two of the clock shift value, velocity offset value and gate time rate, rather than all of these values. Further, the groove template may include any other parameter, such as a pitch shift value, velocity increase/decrease rate and/or gate time shift value. In addition, the play effect data may be arranged to contain only desired one or two of the quantization strength, groove timing, groove time and groove velocity, rather than all of these parameters. Further, the play effect data may include any other parameter.

The performance data, such as data of the note sequence tracks, chord sequence track, pattern sequence track, play effect track and accompaniment pattern track, used in the embodiment of the present invention may be in any desired format other than the above-described event plus relative times format where an occurrence time of each performance event is expressed by an elapsed time (the number of clock pulses counted) from a preceding event, such as the "event plus absolute time" format where an occurrence time of each performance event is expressed by an absolute time within a music piece or measure, and the so-called "solid" format where a memory location is allocated for each minimum resolution unit (clock pulse in the embodiment) of an event and each event data is stored at one of the memory locations corresponding to an occurrence time of the event.

Furthermore, the automatic performance tempo may be changed in any desired manner; for example, it may be changed by varying a tempo clock (interrupt signal) frequency, modifying a timing data value while maintaining a constant tempo clock frequency or varying a value (for example, a unit decrement) used to count timing data per operation.

The automatic performance data may be in a format where data for a plurality of channels are stored together in a mixed format or in a format where data for each channel is stored in a separate track.

The embodiment has also been described above in relation to the case where the accompaniment patterns, groove templates and automatic performance program are prestored in the ROM 2, but the present invention is not so limited and may be arranged as follows. That is, the accompaniment patterns, groove templates and automatic performance program may be prestored in a CD-ROM, and the automatic performance program may be loaded from the CD-ROM device onto a hard disk so that the CPU 1 reads the loaded CD-ROM into the RAM 3 and controls automatic performance operations on the basis of the program in the RAM 3 as in the above-described embodiment. With this arrangement, the CPU 1 is allowed to operate in much the same way as where the automatic performance program is prestored in the ROM 2, and it is possible to greatly facilitate installation or addition of a new automatic performance program or version-up of the automatic performance program. As another alternative, the accompaniment patterns, groove templates and automatic performance program may be prerecorded on a floppy disk, magneto-optical (MO) disk or the like and supplied to the RAM 3 or hard disk whenever necessary.

Moreover, the accompaniment patterns, groove templates and automatic performance program may be downloaded by use of the communication interface 13. In this case, the musical instrument may be connected to the communication network B, such as a LAN (Local Area Network), Internet or telephone network, so as to receive any of the accompaniment patterns, songs, groove templates and automatic performance program from the server computer C by way of the communication network B. The thus-received data and program may be recorded onto the hard disk, to thereby complete the downloading.

Any other type of electronic musical instrument than the keyboard-type instrument, such as a stringed instrument, wind instrument or percussion instrument, may be employed to generate a tone in the present invention. Further, the present invention may be embodied as, rather than the integrated-type electronic musical instrument containing a tone generator circuit and automatic performance function as described, a discrete-type where a tone generator module, sequencer module and effector module are provided separately from each other and are interconnected via, for example, a MIDI and/or network communication means.

The present invention may be embodied as a personal computer running application software rather than a dedicated tone generating device. In such a case, automatic performance data and program may be supplied, as application software, from an external storage device to a hard disk or the like as in the above-described embodiment so that a CPU of the personal computer can perform various operations, similar to those in the described embodiment, using a working area of a RAM and by means of an operating system (OS) installed in the hard disk or the like. When a selection is to be made of the automatic performance data or modification data is to be entered, such a selection or modification data entry can be controlled easily such as by user's operation using a keyboard, mouse or the like. In addition, the tone generator circuit may be implemented by a sound board or the like attached to the personal computer. In the case where a personal computer is employed like this too, accompaniment patterns, groove templates and automatic performance program may be supplied to the personal computer via a communication network.

Any tone signal generation method may be used in the tone generator circuit or sound board depending on an application intended. For example, any conventionally known tone signal generation method may be used, such as the memory readout (waveform memory) method, FM method, physical model method, harmonics synthesis method, formant synthesis method and analog synthesizer method using a combination of VCO, VCF and VCA. Further, the tone generator circuit may be implemented by a combined use of a DSP and microprograms or of a CPU and software programs, rather than by use of dedicated hardware. The tone generation channels to simultaneously generate tone signals in the tone generator circuit may be implemented by using a single circuit on a time-divisional basis or by providing a separate circuit for each of the channels.

Note that the recording medium containing the automatic performance program as described above in relation to the embodiment, such as the ROM, RAM, hard disk, CD-ROM, magneto optical disk, DVD (Digital Versatile Disk) or storage device of the server computer on the communication network, constitutes a recording medium of the present invention.

In summary, by executing the automatic performance program recorded in the automatic performance device or recording medium of the present invention, tonal factor variations can be modified in real time in accordance with the progression of an automatically-performed music piece and then can be reproduced repeatedly any desired number of times with the real-time modifications.

In addition, through execution of the automatic performance program recorded in the automatic performance device or recording medium of the present invention, modification data as desired by the user can be written into a modification data storage section.

Further, each time switching is effected between the groove data, the execution of the automatic performance program recorded in the automatic performance device or recording medium of the present invention can appropriately modify the newly read-out groove data in accordance with reference modification data corresponding thereto.

Moreover, because the automatic performance program includes, in addition to the above-stated arrangements, a further specific arrangement for resetting to the reference modification data at the time of the groove data switching, it not only permits real-time modification of tonal factor variations in accordance with the progression of an automatically-performed music piece and subsequent reproduction of the tonal factor vartions with the real-time modifications, but also allows newly read-out groove data to be modified in accordance with reference modification data each time switching is effected between the groove data.

What is claimed is:

1. An automatic performance device comprising:

a performance data supply section that supplies automatic performance data;

a groove data supply section that supplies groove data for imparting a variation to one or more predetermined factors of a tone based on the automatic performance data;

a modification data storage section that stores modification data for modifying variation amounts of the one or more predetermined factors, in a time series in corresponding relation to progression of an automatic performance; and a performance executing section that executes an automatic performance by reading out the modification data from said modification data storage section in accordance with the progression of the automatic performance, modifying the variation amounts of the one or more predetermined factors, based on the groove data, in accordance with the modification data and modifying the one or more predetermined factors of the tone based on the automatic performance data in accordance with the modified variation amounts.

2. An automatic performance device as recited in claim 1 wherein during reproduction of an automatic performance, said groove data supply section is capable of supplying the groove data while selectively switching between a plurality of types of the groove data to be supplied thereby and also capable of supplying a plurality of types of reference modification data that are specific to respective ones of the types of the groove data, and wherein when the groove data to be supplied is switched from one of the types to another of the types by said groove data supply section, said performance executing section modifies the variation amounts of the one or more predetermined factors using the reference modification data specific to the groove data of the other type, in place of the modification data read out from said modification data storage section.

3. An automatic performance device as recited in claim 2 wherein said performance executing section includes a temporary storage section for temporarily storing the modification data read out in a time series from said modification data storage section and modifies the variation amounts of the one or more predetermined factors on the basis of the modification data temporarily stored in said temporary storage section, and wherein when the groove data to be supplied is switched from one of the types to another of the types by said groove data supply section, said performance executing section rewrites a content of said temporary storage section in accordance with the reference modification data.

4. An automatic performance device as recited in claim 2 wherein said performance executing section includes a first temporary storage section for temporarily storing the modification data read out in the time series from said modification data storage section and a second temporary storage section for temporarily storing the reference modification data and modifies the variation amounts of the one or more predetermined factors on the basis of the modification data temporarily stored in said first temporary storage section and the reference modification data stored in said second temporary storage section, and wherein when the groove data to be supplied is switched from one of the types to another of the types by said groove data supply section, said performance executing section writes the reference modification data into said second temporary storage section and resets a content of said first temporary storage section.

5. An automatic performance device as recited in claim 1 wherein said performance data supply section includes a storage section that stores the automatic performance data of a plurality of tracks, and said modification data storage section stores the modification data of a plurality of tracks corresponding to the automatic performance data of the plurality of tracks, and wherein said performance executing section, independently for each of the tracks, modifies the variation amounts of the one or more predetermined factors for the automatic performance data of said track in accordance with the modification data of said track.

6. An automatic performance device comprising:

a performance data supply section that supplies automatic performance data;

a groove data supply section that supplies groove data for imparting a variation to one or more predetermined factors of a tone based on the automatic performance data;

a writable modification data storage section that stores modification data for modifying variation amounts of the one or more predetermined factors, in a time series in corresponding relation to progression of an automatic performance;

a modification data writing section that receives desired modification data and writes the desired modification data into said modification data storage section; and a performance executing section that executes an automatic performance by reading out the modification data from said modification data storage section in accordance with the progression of the automatic performance, modifying the variation amounts of the one or more predetermined factors, based on the groove data, in accordance with the modification data and modifying the one or more predetermined factors of said tone based on the automatic performance data in accordance with the modified variation amounts.

7. An automatic performance method comprising the steps of:

supplying automatic performance data;

supplying groove data for imparting a variation to one or more predetermined factors of a tone based on the automatic performance data;

reading out, from a memory storing modification data for modifying variation amounts of the one or more predetermined factors in a time series in corresponding relation to progression of an automatic performance, the modification data in accordance with progression of an automatic performance; and executing an automatic performance by modifying the variation amounts of the one or more predetermined factors, based on the groove data, in accordance with the modification data read out from the memory and modifying the one or more predetermined factors of said tone based on the automatic performance data in accordance with the modified variation amounts.

8. An automatic performance method as recited in claim 7 wherein during reproduction of an automatic performance, said step of supplying groove data is capable of supplying the groove data while selectively switching between a plurality of types of the groove data to be supplied thereby and also capable of supplying a plurality of types of reference modification data specific to respective ones of the types of the groove data, and wherein when the groove data to be supplied is switched from one of the types to another by said step of supplying groove data, said step of executing an automatic performance modifies the variation amounts of the one or more predetermined factors using the reference modification data specific to the groove data of the other type, in place of the modification data read out from the memory in the time series.

9. An automatic performance method as recited in claim 7 wherein said step of supplying automatic performance data supplies the automatic performance data of a plurality of tracks, and said step of reading out reads out, from the memory storing the modification data in corresponding relation to the plurality of tracks, said modification data of a plurality of tracks corresponding to the automatic performance data of the plurality of tracks in accordance with progression of an automatic performance, and wherein said step of executing an automatic performance, independently for each of the tracks, modifies the variation amounts of the one or more predetermined factors for the automatic performance data of said track in accordance with the modification data of said track, to thereby execute an automatic performance for each of the tracks.

10. An automatic performance method comprising the steps of:

supplying automatic performance data;

supplying groove data for imparting a variation to one or more predetermined factors of a tone based on the automatic performance data;

receiving desired modification data and writing the desired modification data into a memory in a time series in corresponding relation to progression of an automatic performance; and executing an automatic performance by reading out the modification data from said memory in accordance with the progression of the automatic performance, modifying the variation amounts of the one or more predetermined factors, based on the groove data, in accordance with the modification data and modifying the one or more predetermined factors of said tone based on the automatic performance data in accordance with the modified variation amounts.

11. A machine-readable recording medium containing a group of instructions of an automatic performance program to be executed by a computer, said automatic performance program comprising the steps of:

supplying automatic performance data;

supplying groove data for imparting a variation to one or more predetermined factors of a tone based on the automatic performance data;

reading out, from a memory storing modification data for modifying variation amounts of the one or more predetermined factors in a time series in corresponding relation to progression of an automatic performance, the modification data in accordance with progression of an automatic performance; and executing an automatic performance by modifying the variation amounts of the one or more predetermined factors, based on the groove data, in accordance with the modification data read out from the memory and modifying the one or more predetermined factors of said tone based on the automatic performance data in accordance with the modified variation amounts.

12. A machine-readable recording medium as recited in claim 11 wherein during reproduction of an automatic performance, said step of supplying groove data is capable of supplying the groove data while selectively switching between a plurality of types of the groove data to be supplied thereby and also capable of supplying a plurality of types of reference modification data specific to respective ones of the types of the groove data and wherein when the groove data to be supplied is switched from one of the types to another of the types by said step of supplying groove data, said step of executing an automatic performance modifies the variation amounts of the one or more predetermined factors using the reference modification data specific to the groove data of the other type, in place of the modification data read out from the memory in the time series.

13. A machine-readable recording medium as recited in claim 11 wherein said step of supplying automatic performance data supplies the automatic performance data of a plurality of tracks, and said step of reading out reads out, from the memory storing the modification data in corresponding relation to the plurality of tracks, the modification data of the plurality of tracks corresponding to the automatic performance data of the plurality of tracks in accordance with progression of an automatic performance, and wherein said step of executing an automatic performance, independently for each of the tracks, modifies the variation amounts of the one or more predetermined factors for the automatic performance data of said track in accordance with the modification data of said track, to thereby execute an automatic performance for each of the tracks.

14. A machine-readable recording medium containing a group of instructions of an automatic performance program to be executed by a computer, said automatic performance program comprising the steps of:

supplying automatic performance data;

supplying groove data for imparting a variation to one or more predetermined factors of a tone based on the automatic performance data;

receiving desired modification data and writing the desired modification data into a memory in a time series in corresponding relation to progression of an automatic performance; and executing an automatic performance by reading out the modification data from said memory in accordance with the progression of the automatic performance, modifying the variation amounts of the one or more predetermined factors, based on the groove data, in accordance with the modification data and modifying the one or more predetermined factors of said tone based on the automatic performance data in accordance with the modified variation amounts.

15. An automatic performance device capable of varying a tonal factor of automatic performance data on the basis of a variation-imparting pattern containing variation amount data for varying a tonal factor, said automatic performance device comprising:

a modification data storage section that stores modification data for modifying the variation amount data in accordance with progression of an automatic performance, in a time series in corresponding relation to the automatic performance data;

a first readout section that, during reproduction of the automatic performance data, sequentially reads out the modification data stored in said modification data storage section;

a second readout section that, during reproduction of the automatic performance data, sequentially reads out the variation amount data of the variation-imparting pattern; and a performance executing section that executes an automatic performance by varying the tonal factor of the automatic performance data in accordance with the modification data read out by said first readout section and the variation amount data read out by said second readout section.

16. An automatic performance device as recited in claim 15 wherein a plurality of types of the variation-imparting pattern are stored in a memory, and which further comprises a readout order designating section that designate order of reading out said plurality of types of the variation-imparting pattern from the memory in corresponding relation to the automatic performance data, said second readout section sequentially reading out the variation amount data of the variation-imparting pattern being designated by said readout order designating section in accordance with progression of the reproduction of the automatic performance data.

17. An automatic performance device capable of varying a tonal factor of automatic performance data on the basis of a variation-imparting pattern containing variation amount data for varying a tonal factor, said automatic performance device comprising:

a modification data storage section that stores modification data for modifying the variation amount data in accordance with progression of an automatic performance, in corresponding relation to the automatic performance data;

a modification data input section that receives the modification data;

a modification data writing section that writes the modification data, received via said modification data input section, into said modification data storage section in a time series;

a first readout section that, during reproduction of the automatic performance data, sequentially reads out the modification data stored in said modification data storage section;

a second readout section that, during reproduction of the automatic performance data, sequentially reads out the variation amount data of the variation-imparting pattern; and a performance executing section that executes an automatic performance by varying the tonal factor of the automatic performance data in accordance with the modification data read out by said first readout section and the variation amount data read out by said second readout section.

18. An automatic performance device as recited in claim 17 wherein a plurality of types of the variation-imparting pattern are stored in a memory, and which further comprises a readout order designating section that designate order of reading out the plurality of types of the variation-imparting pattern from the memory in corresponding relation to the automatic performance data, said second readout section sequentially reading out the variation amount data of the variation-imparting pattern being designated by said readout order designating section in accordance with progression of the reproduction of the automatic performance data.

* * * * *